US006269578B1

(12) United States Patent
Callegari

(10) Patent No.: US 6,269,578 B1
(45) Date of Patent: Aug. 7, 2001

(54) WEAPON BENCHREST

(76) Inventor: Gino A. Callegari, 470-865 Diane Dr., Susanville, CA (US) 96130

( * ) Notice: Subject to any disclaimer, the term of this patent is extended or adjusted under 35 U.S.C. 154(b) by 0 days.

(21) Appl. No.: 09/478,950

(22) Filed: Jan. 7, 2000

(51) Int. Cl.[7] ..... F41A 27/00
(52) U.S. Cl. ..... 42/94; 297/172
(58) Field of Search ..... 42/94

(56) References Cited

U.S. PATENT DOCUMENTS

| | | | | |
|---|---|---|---|---|
| 4,937,965 | | 7/1990 | Narvaez | 42/94 |
| 5,060,410 | * | 10/1991 | Mueller | 42/94 |
| 5,397,147 | | 3/1995 | Ducharme et al. | 280/415.1 |
| 5,414,949 | * | 5/1995 | Peebles | 42/94 |
| 5,491,921 | * | 2/1996 | Allen | 42/94 |
| 5,697,180 | * | 12/1997 | Morizio | 42/94 |
| 5,715,625 | | 2/1998 | West, III | 42/94 |
| 5,833,308 | * | 11/1998 | Strong, III et al. | 297/172 |
| 5,884,966 | | 3/1999 | Hill et al. | 297/170 |
| 6,058,641 | * | 5/2000 | Vecqueray | 42/94 |

* cited by examiner

*Primary Examiner*—Charles T. Jordan
*Assistant Examiner*—Denise J. Buckley
(74) *Attorney, Agent, or Firm*—Henderson & Sturm LLP

(57) ABSTRACT

A weapon benchrest in combination with a vehicle receiver hitch. The benchrest includes a main support frame with one end received in and supported by the vehicle receiver hitch and the other end supporting a weapon support table. A seat is attached to the main frame intermediate the ends, and a ground engaging stabilizer is attached to the main frame remote from the hitch. The benchrest is fully adjustable in that the seat is horizontally adjustable, the stabilizer is vertically adjustable, and the table is both horizontally and vertically adjustable. The benchrest may use either a bi-level weapon support table with rifle rests, or a flat table for use with an additional rifle bench, vice or rest.

11 Claims, 2 Drawing Sheets

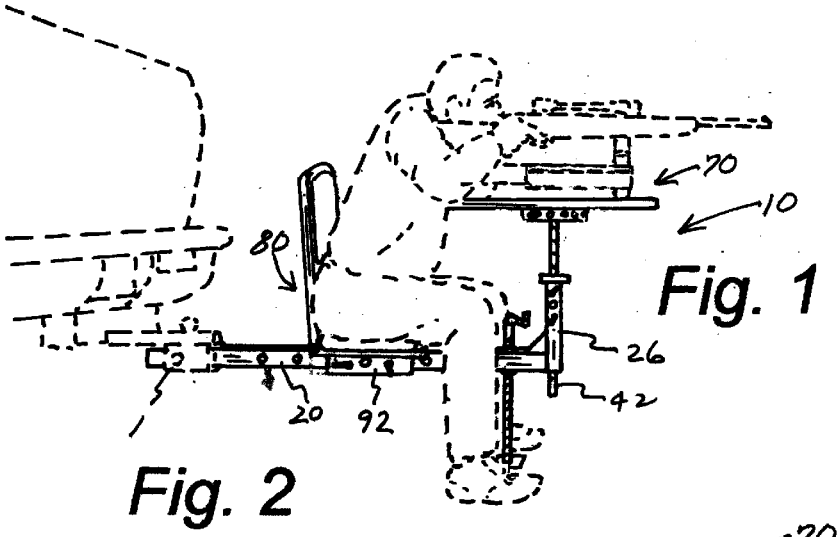
Fig. 1
Fig. 2
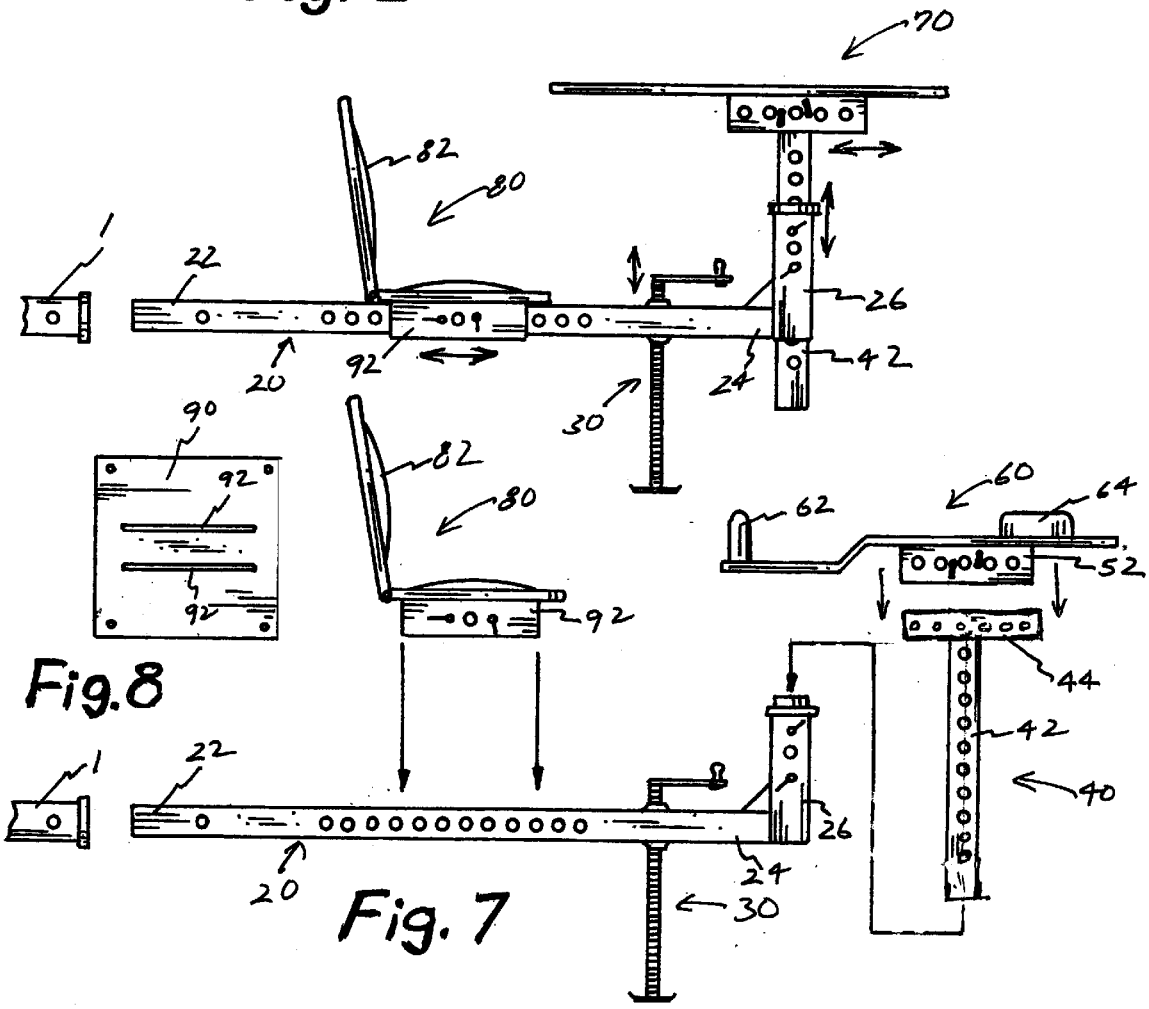
Fig.8
Fig. 7

WEAPON BENCHREST

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of weapon sighting devices and more particularly to a weapon benchrest.

2. Description of Related Art

As can be seen by reference to the following U.S. Pat. Nos. 4,937,965; 5,397,147; 5,715,625 and 5,884,966 the prior art is replete with myriad and diverse portable and adjustable shooting benches.

While all of the aforementioned prior art constructions are more than adequate for the basic purpose and function for which they have been specifically designed, they are uniformly deficient with respect to their failure to provide a simple, efficient, and practical weapon benchrest.

As a consequence of the foregoing situation, there has existed a longstanding need for a new and improved weapon benchrest and the provision of such a construction is a stated objective of the present invention.

BRIEF SUMMARY OF THE INVENTION

Briefly stated, the present invention provides a weapon benchrest in combination with a vehicle receiver hitch. The benchrest includes a main support frame with one end received in and supported by the vehicle receiver hitch and the other end supporting a weapon support table. A seat is attached to the main frame intermediate the ends, and a ground engaging stabilizer is attached to the main frame remote from the hitch. The benchrest is fully adjustable in that the seat is horizontally adjustable, the stabilizer is vertically adjustable, and the table is both horizontally and vertically adjustable. The benchrest may use either a bi-level weapon support table with rifle rests, or a flat table for use with an additional rifle bench, vice or rest.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein;

FIG. 1 is a perspective view showing the weapon benchrest of the present invention attached to the receiver hitch of a vehicle;

FIG. 2 is a side elevational view showing the weapon benchrest using a flat table;

FIG. 7 is an exploded side elevational view showing the weapon benchrest using a bi-level table and showing the seat and table as they attach to the main support frame; and FIG. 8 is a bottom plan view of the seat mounting plate.

DETAILED DESCRIPTION OF THE INVENTION

Figure 3:
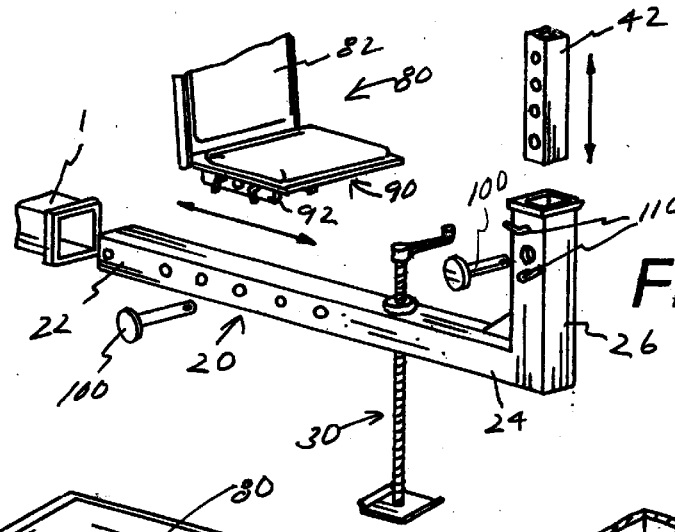
FIG. 3 is a partial exploded perspective view illustrating the horizontal adjustability of the seat and the vertical adjustment of the table.

As can be seen by reference to the drawings, and in particularly to FIG. 1, the weapon benchrest that forms the basis of the present invention is designated generally by the reference number 10. The benchrest 10 is adapted for use in combination with a vehicle receiver hitch 1. The benchrest 10 includes a main support frame 20 with a first end 22 telescopically received in and supported by the receiver hitch 1, and a second end 24 that carries a vertically disposed socket 26. A crank operated stabilizer jack 30 is attached to the main frame 20 near the second end 24.

Figure 6:
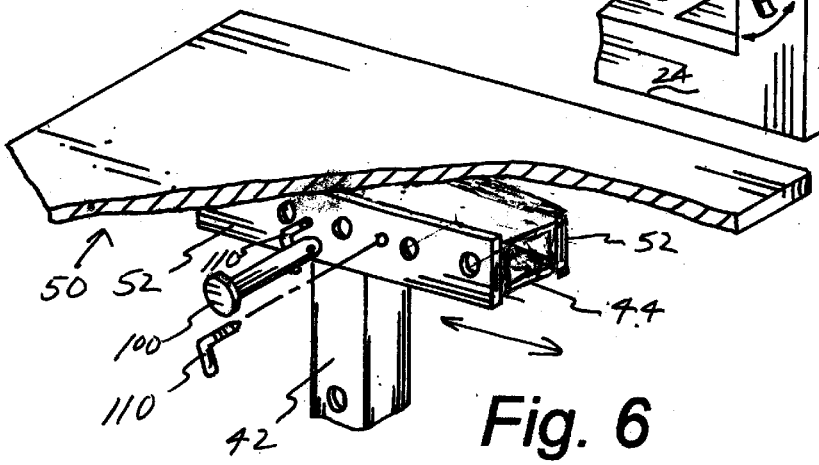
FIG. 6 is a partial perspective view illustrating the horizontal adjustability of the table.

A table support frame 40 has a vertical leg 42 that is telescopically received in the vertical socket 26, and a horizontal leg 44 that slidably carries a table plate 50, as illustrated in FIGS. 2 and 6. The table plate 50 includes downwardly depending spaced tabs 52 that engage opposing sides of the horizontal leg 44. The table plate 50 may support either a bi-level table 60 with rifle rests 62 and 64 (FIG. 7), or a flat table 70 (FIG. 2) for use with an additional rifle bench, vice or rest.

Figure 4:
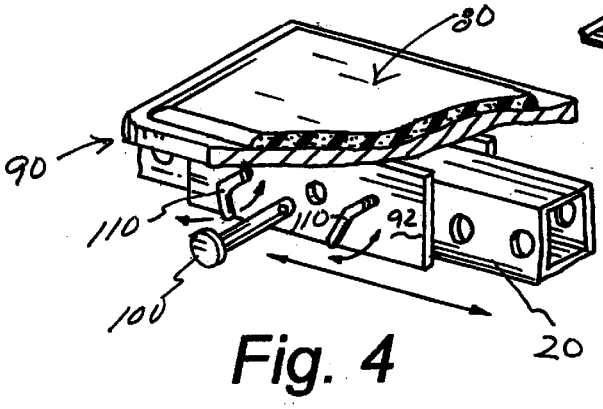
FIG. 4 is a partial perspective view illustrating the horizontal adjustability of the seat.
Figure 5:
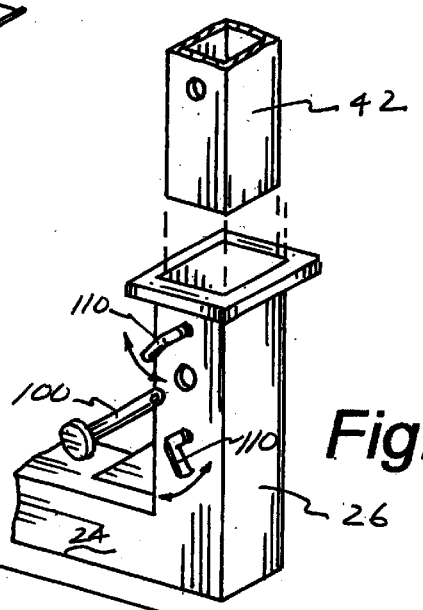
FIG. 5 is a partial perspective view illustrating the vertical adjustability of the table.

A seat 80 with an attached backrest 82 is supported on a seat plate 90 including downwardly depending spaced tabs 92. The seat plate 90 is slidably carried on the main frame 20 as illustrated in FIGS. 2 and 4 where the tabs 92 engage opposing sides of the main frame 20.

The positions of the seat 80 and tables 60, 70 are adjustable as indicated, and are secured by engagement of pins 100 in registered openings in the components. If the portion of the registered openings results in an adjustment that is not suitable to the user, the pins 100 may be removed and the winged-end set screws 110 may be used to secure the desired adjustment.

The seat 80 is horizontally adjustable fore-and-aft, the stabilizer 30 is vertically adjustable by operation of the crank 30, and the tables 60, 70 are both horizontally and vertically adjustable. The field weapon benchrest 10 of the present invention is completely stable in use, and enables the shooter to hold the sights solidly and absolutely stationary on the desired target while zeroing-in the rifle or weapon.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A weapon benchrest for use in combination with a vehicle receiver hitch, the benchrest comprising:

a horizontal main support frame having a first end disposed to be received in and supported by the vehicle receiver hitch, and a second end;

a weapon support table attached to the main support frame near the second end thereof; and a vertical stabilizer attached to the main support frame near the second end thereof and disposed to extend downwardly therefrom to selectively engage a ground surface.

2. The benchrest of claim 1 further including a seat attached to the main support frame intermediate the first and second ends thereof.

3. The benchrest of claim 1 wherein the weapon support table is vertically adjustable with respect to the main support frame.

4. The benchrest of claim 1 wherein the weapon support table is horizontally adjustable with respect to the main support frame.

5. The benchrest of claim 2 wherein the weapon support table is vertically adjustable with respect to the main support frame.

6. The benchrest of claim 2 wherein the weapon support table is horizontally adjustable with respect to the main support frame.

7. The benchrest of claim 2 wherein the seat is horizontally adjustable with respect to the main support frame.

8. The benchrest of claim 1 wherein the seat is horizontally adjustable with respect to the main support frame.

9. The benchrest of claim 1 wherein the seat is horizontally adjustable with respect to the main support frame.

10. The benchrest of claim 3 wherein the seat is horizontally adjustable with respect to the main support frame.

11. The benchrest of claim 4 wherein the seat is horizontally adjustable with respect to the main support frame.

* * * * *